US010527285B2

(12) United States Patent
Cook

(10) Patent No.: US 10,527,285 B2
(45) Date of Patent: Jan. 7, 2020

(54) SPARKLESS IGNITERS AND METHODS FOR PILOT IGNITION

(71) Applicant: Surefire Pilotless Burner Systems LLC, Aztec, NM (US)

(72) Inventor: Ronnie Cook, Aztec, NM (US)

(73) Assignee: SUREFIRE PILOTLESS BURNER SYSTEMS LLC, Farmington, NM (US)

( * ) Notice: Subject to any disclaimer, the term of this patent is extended or adjusted under 35 U.S.C. 154(b) by 305 days.

(21) Appl. No.: 15/470,817

(22) Filed: Mar. 27, 2017

(65) Prior Publication Data

US 2017/0284669 A1 Oct. 5, 2017

Related U.S. Application Data

(60) Provisional application No. 62/315,555, filed on Mar. 30, 2016.

(51) Int. Cl.

| | |
|---|---|
| ***F23N 5/20*** | (2006.01) |
| ***F23Q 9/08*** | (2006.01) |
| ***F23Q 7/06*** | (2006.01) |
| ***F23D 14/76*** | (2006.01) |
| ***F23Q 7/00*** | (2006.01) |

(52) U.S. Cl.

CPC ..... *F23Q 9/08* (2013.01); *F23D 14/76* (2013.01); *F23Q 7/00* (2013.01); *F23Q 7/06* (2013.01); *F23D 2900/00014* (2013.01); *F23N 2027/22* (2013.01)

(58) Field of Classification Search

CPC .. F23D 2207/00; F23D 2207/022; F23Q 7/06; F23Q 7/10; F23Q 7/00; F23Q 7/24; F23Q 9/00; F23Q 9/08; F23Q 9/12; F23Q 9/14

USPC ..... 431/5, 6, 196, 202, 254–263

See application file for complete search history.

(56) References Cited

U.S. PATENT DOCUMENTS

| | | | | |
|---|---|---|---|---|
| 4,405,299 | A | 9/1983 | Serber | |
| 8,434,292 | B2 | 5/2013 | Eason et al. | |
| 2006/0172238 | A1 | 8/2006 | Cook | |
| 2007/0145032 | A1* | 6/2007 | Graham | F23D 14/105 219/392 |
| 2011/0269080 | A1* | 11/2011 | Shukert | F23D 14/725 431/6 |
| 2012/0282555 | A1* | 11/2012 | Cody | F23D 14/04 431/5 |

* cited by examiner

*Primary Examiner* — Vivek K Shirsat

(74) *Attorney, Agent, or Firm* — ipTekk, LLC; Anand S. Chellappa

(57) ABSTRACT

Sparkless igniters for pilot services comprising hot surface igniter elements, and methods for operating these igniters without the use of flame rods or thermocouples. The electrical resistance of the hot surface igniter element is measured and used to control the operation of the igniters using a suitable burner management system. The measured electrical resistance may also be manipulated to yield a control parameter for use in the burner management system. The igniters are designed to prevent quenching of the hot surface elements by the fuel-air mixture. The igniters optionally permit easy swap out of hot surface igniter elements.

14 Claims, 8 Drawing Sheets

SPARKLESS IGNITERS AND METHODS FOR PILOT IGNITION

CROSS REFERENCE TO RELATED APPLICATIONS

Figure 1A:
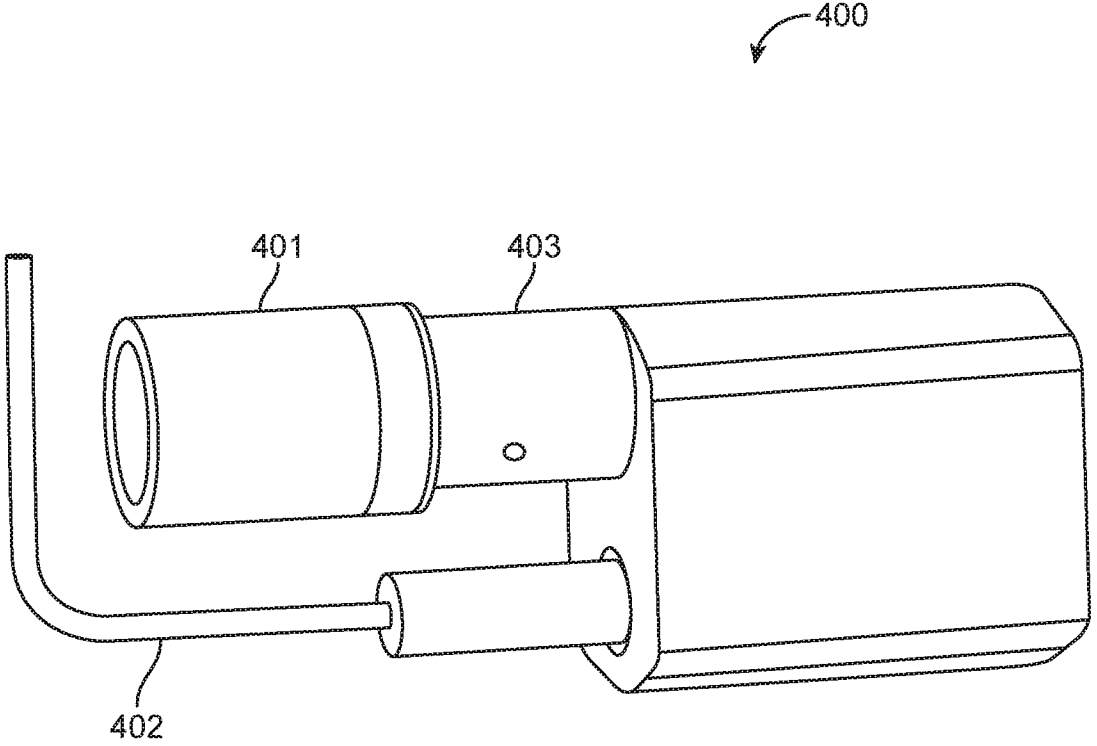
FIG. 1A (PRIOR ART)

This application claims the benefit of U.S. Provisional Patent Application No. 62/315,555, filed on Mar. 30, 2016.

FIELD

The present disclosure relates, in general, to the field of combustion systems, and in particular, to sparkless igniters and methods for pilot ignition.

BACKGROUND

Natural gas is a byproduct formed during oil extraction from oil wells, and is typically referred to as wellhead gas. Wellhead gas comprises a mixture of methane, ethane, propane, nitrogen, carbon dioxide, and water. In addition, wellhead gas may contain varying amounts of sulfur compounds such as hydrogen sulfide. Because of the remote location of the well sites, it is often not economical to collect this gas and transport it for further value added processing. Rather, the gas is flared, a term that refers to the combustion of wellhead gases.

Flaring or combustion of wellhead gases is initiated and controlled using a burner management system. A burner management system is also used to control ignition in chemical process burners and incinerators. The burner management system controls the operation of an igniter. Ignition in turn could be achieved by spark ignition or sparkless ignition. Further, depending on the quantity of gas produced at the wellheads, or the flow rate of fuel in process burners, or the heat duty of the ignition system, the system could use a pilot flame, or could be pilotless. Generally, ignition systems rated at >125,000 BTU utilize a pilot to initiate ignition. The pilot flame is fueled by a dedicated fuel line and is available to ignite relieved gases when needed. For example, Zeeco Inc.'s wellhead flare is equipped with high stability, low flow spark ignited pilot, which can withstand hurricane force winds of 170 mph with zero flame failure. In the case of spark ignition, the sparking tips require periodic cleaning to remove carbon accumulation formed as a byproduct of combustion. Further, periodic adjustment is required to maintain the spark gap between the two electrodes in a spark igniter. Therefore, there is an increasing interest in using sparkless ignition for piloted systems.

U.S. application Ser. No. 13/284,393 entitled "HOT SURFACE IGNITION ASSEMBLY FOR USE IN PILOTS FOR FLARING, INCINERATION, AND PROCESS BURNERS" filed on Oct. 28, 2011, describes a sparkless ignition device for a piloted flare. A hot surface ignition (HSI) assembly is positioned proximate to the pilot head and produces heat by induction sufficient to ignite the pilot fuel. The HSI operates at or above temperatures of 2100° F. (about 1149° C.). A thermocouple is positioned near the pilot head to sense the temperature of the pilot exhaust gas. A control system uses the measured temperature to reduce, start, or stop the current passing through the insulated element of the HSI. The HSI assembly could be affixed to the pilot head by a threaded or welded fitting. The HSI assembly is built to be a drop-in replacement to sparking technology that is widely used today. Igniters, and methods to enable reliable operation of igniters without the use of a flame rod or a thermocouple to sense a flame were not disclosed.

U.S. application Ser. No. 11/047,794 entitled "METHOD, APPARATUS AND SYSTEM FOR CONTROLLING A GAS-FIRED HEATER," and filed by the applicant on Feb. 1, 2005, and incorporated by reference herein in its entirety, discloses that the HSI assembly preferably comprises a silicon nitride element that has a rated temperature of at least 1000° C. at 12 volts. However, the above application did not disclose igniters and methods to use the HSI assembly itself to detect the presence or absence of a pilot flame, or how to solve the problem of temperature quenching of the HSI assembly in a compact pilot igniter when the HSI assembly is also used as a flame sensor.

A flame sensor such as a flame rod or a thermocouple is used to detect a flame, and feeds a suitable signal to the burner management system. In the case of a flame rod, an AC current is applied to the flame rod such as Kanthal flame rods rated to 2600° F. (available for example, from Honeywell), which then flows through the ions in the flame, and to the pilot assembly/head to ground. Because the surface area of the flame rod is much smaller than that of the pilot head, the AC current is rectified to DC current in the process commonly known as flame rectification. The magnitude of this current could vary from 0.25 to 8 mA. Armored wiring harness rated at 500° F. or above is used. The burner management systems opens the main gas valve to the igniter if it detects a DC current of pre-determined magnitude. Flame rods require periodic maintenance because of carbon formation (soot) on the sensors. In addition, the extreme temperatures seen at remote wellheads may also lead to crack formation in the ceramic insulators of the sensor rods. Finally, the sensor rods also tend to corrode.

As an alternative to flame rods, thermocouples may be used to sense the temperature of the flame and/or exhaust gases. An exemplary thermocouple is the K-type thermocouple, which is rated to 2400° F. Because these thermocouples are located in the flame, they are usually sheathed in high temperature metal sheaths such as Inconel. Inconel sheaths increase the cost of thermocouples, and thereby the cost of the igniters. Further, they are subject to the deficiencies that are seen in flame rods. Finally, even when the flame goes out, the measured temperature gradually decreases, resulting in a lag period between the time the flame goes out and the time the burner management system senses that the flame is indeed out and takes corrective action. Unburnt fuel is therefore exhausted into the atmosphere. An alternative to flame rods and thermocouples is therefore desired to minimize costs and to improve the operation and reliability of sparkless igniters and ignition systems.

HSI assemblies can also be used in pilotless burner systems. U.S. Pat. No. 8,434,292 entitled "CERAMIC-ENCASED HOT SURFACE IGNITER SYSTEM FOR JET ENGINES," and issued on May 7, 2013, discloses HSI assemblies for igniting fuel in jet engines. The disclosed HSI assemblies were encased in silicon nitride. These fit-for-purpose specially designed HSI assemblies were capable of maintaining temperature in turbulent flow conditions commonly seen in an operating jet engine, and employed specific geometries of the ceramic encasement, multiple igniter elements, and control strategies. Since the igniter temperature maybe quenched due to convective cooling, the voltage to the igniter element could be increased by the control system, thereby increasing the power flowing through the internal resistive heating element. This action created a corresponding rise in temperature to allow the HSI assembly's external surface to reach temperatures sufficient for auto ignition to occur. A sparkless igniter for use as a pilot that employs commercially available HSI assemblies and designs to mitigate the effects of convective cooling was however not disclosed.

Figure 1B:
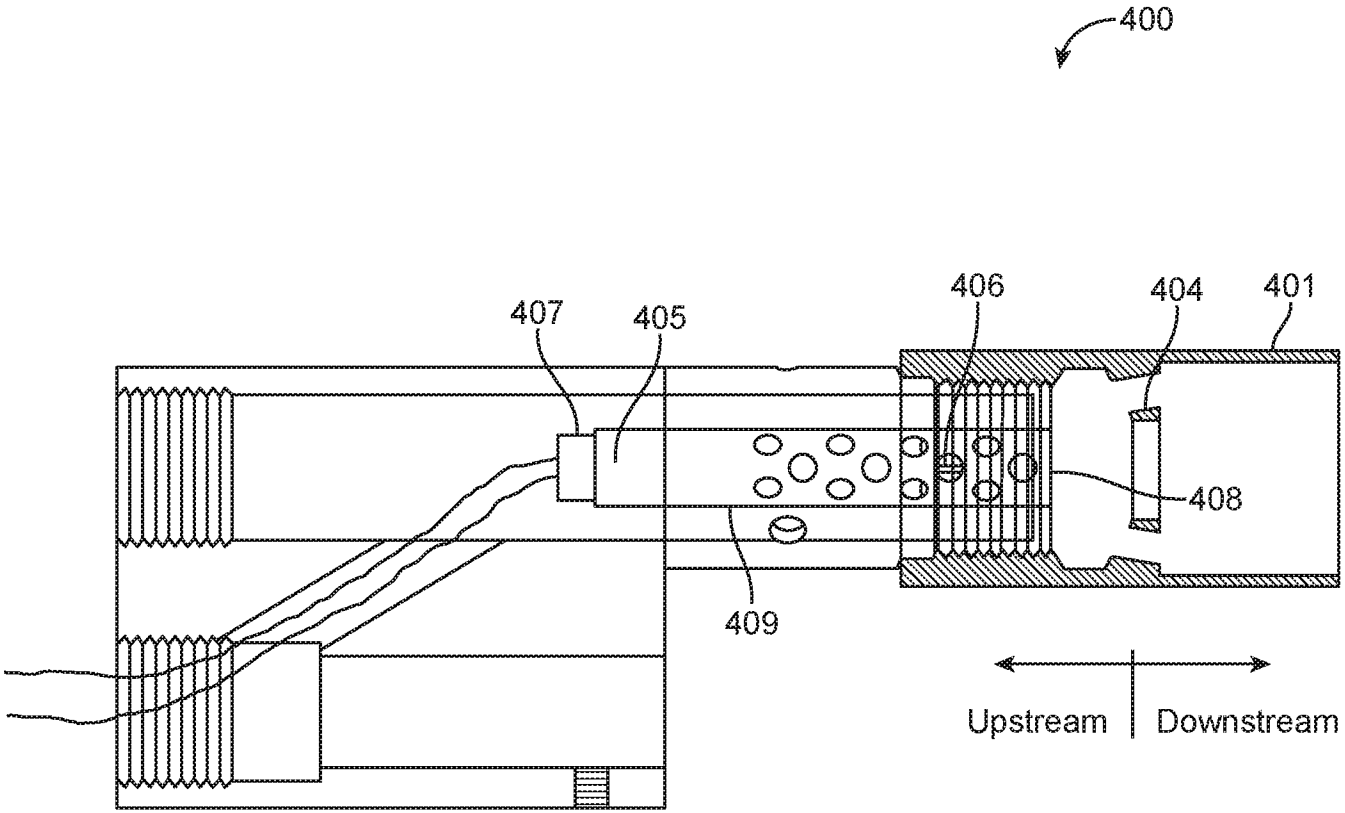
FIG. 1B (PRIOR ART)
Figure 1C:
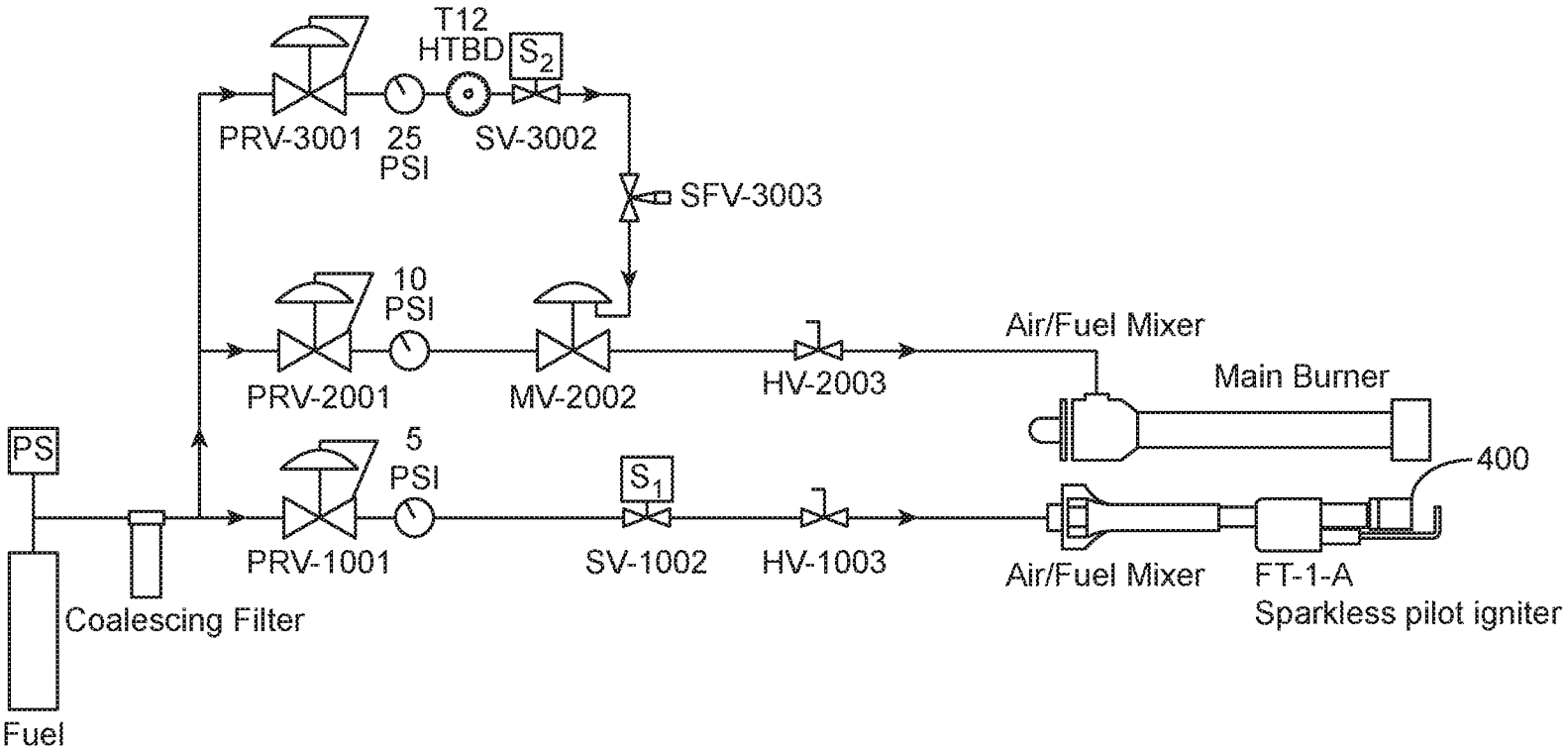

The applicant currently sells sparkless igniters for pilot services. An example of a sparkless pilot igniter 400 is shown in FIG. 1(*a*). Pre-mixed fuel and air enters the igniter 400 and flows into the nozzle 401. The nozzle is removably connected to neck 403 of the igniter. The igniter is equipped with a flame rod 402, which senses the presence or absence of the pilot flame, and feeds the signal to a burner management system. In some models, a thermocouple is used instead of the flame rod. FIG. 1(*b*) provides additional details related to the location of a hot surface igniter (HSI) assembly 405 inside the igniter. HSI assembly 405 is cylindrical in shape and comprises a heating element 406 that is substantially enclosed in a high temperature ceramic body 407. A high temperature alloy guard (e.g. Inconel guard) 409 protects the ceramic body, and the exposed part of the heating element 406. The HSI assembly is positioned such that the tip 408 is located upstream of the nozzle throat 404. When the energized hot element 406 is exposed to a fuel air mixture, a flame is produced and extends through the throat of the nozzle 404 and into the nozzle 401. The flame body (or plume) therefore sits above the tip 408 and the nozzle throat 404. Since the tip does not sit in the flame plume, it is subject to convectional cooling by the flow of the incoming fuel-air mixture. As a result, the HSI assembly in this arrangement cannot be used to detect the presence or absence of the pilot flame reliably by measuring the change in resistance of the element 406 prior to, and after ignition. This is because the resistance of element 406 is a function of temperature, and convectional cooling of the element 406 would lead to an artificial change in temperature (and hence resistance) that is not related to the presence or absence of a flame. A flame rod 402 (or thermocouple) is therefore required to sense the flame and adds on to the cost of the igniter, in addition to requiring maintenance, as described above.

FIG. 1(*c*) schematically shows the installation of the sparkless pilot igniter 400 in the burner management system. At start-up, the HSI element in the pilot igniter is energized before the fuel is fed to the pilot. The fuel pressure is controlled to about 5 psig using regulator PRV-1001, and the fuel is routed through a fail-safe pilot fuel valve SV-1002 to the sparkles pilot igniter. Auto-ignition of the fuel-air mixture on the hot surface of the HSI element of the pilot igniter is detected using a flame sensor (thermocouple or flame rod). If a flame is detected, fuel is routed through main fuel burner valve MV-2002 to the main burner. If a flame is not detected at the pilot within the predetermined time, the fuel valves SV-1002 and MV-2002 close and the system recycles.

U.S. Pat. No. 4,405,299 entitled "BURNER IGNITION AND FLAME MONITORING SYSTEM" and issued on Sep. 20, 1983, discloses using a hot surface ignitor as both an ignition element and as a flame rectification sensor (flame rod). A control system alternates between an ignition control circuit and a flame sensing circuit using an ignition control switch. This method requires the use of an alternating current source, which is available in residential homes, but not at remote well sites. Alternative methods and devices for using a DC input source to energize hot surface igniters to ignite a fuel at remote sites, and to utilize the resistance of the igniter element to detect the presence or absence of flame are therefore desired.

A compact, sparkless pilot igniter that can reliably operate without the use of thermocouples or flame rods to sense a flame in conjunction with a suitable burner management system is therefore desired.

BRIEF DISCLOSURE

In one aspect, a sparkless pilot flame igniter comprises a fuel-air mixture inlet and a nozzle in fluid communication with the fuel-air mixture inlet and located downstream of the fuel-air mixture inlet. The nozzle comprises a throat and a hot surface igniter assembly which is removably disposed in the throat such that a portion of the hot surface igniter assembly protrudes from the throat in a direction opposite to the fuel-air mixture inlet. The operation of the igniter is controlled by measuring a control parameter related to the resistance of the hot surface igniter element, and using the change in the value of the control parameter prior to and after ignition to sense the presence or absence of a flame. In one embodiment, the control parameter is the flame strength value (FSV) of the hot surface igniter element.

In another aspect, a sparkless pilot flame igniter comprises an igniter body having a fuel-air mixture conduit disposed on a first side of the longitudinal axis of the body and extending from a fuel-air mixture inlet and through the length of the body. An electrical conduit is disposed substantially parallel to the air-fuel mixture conduit and opposite to the first side of the longitudinal axis. A nozzle is disposed to be in fluid communication with the fuel-air mixture conduit and is located downstream of the fuel-air mixture inlet. The nozzle comprises a throat and a hot surface igniter assembly removably disposed in the throat such that a portion of the hot surface igniter assembly protrudes from the throat in a direction opposite to the fuel-air mixture inlet. The operation of the igniter is controlled by measuring a control parameter related to the resistance of the hot surface igniter element and using the change in the value of the control parameter prior to and after ignition to sense the presence or absence of a flame.

In another aspect, a method of operating a sparkless pilot flame igniter in a burner management system is disclosed. The method comprises providing a hot surface igniter assembly that is energizable using a direct current (DC) source and having a predetermined baseline control parameter that is relatable to electrical resistance of the hot surface igniter element, disposing the hot surface igniter assembly in the throat of the igniter nozzle such that a portion of the hot surface igniter assembly protrudes from the throat in a direction opposite to the fuel-air mixture inlet of the igniter, energizing the hot surface igniter element during a first time interval, initiating a flow of fuel to the igniter through the fuel-air mixture inlet during a second time interval, de-energizing the hot surface igniter assembly and measuring the resistance of the hot surface igniter element, calculating an operating control parameter relatable to measured resistance, and determining the presence of a flame if the value of the operating control parameter exceeds that of the baseline control parameter by a predetermined control value.

In another aspect, the igniter body may comprise of more than one subassemblies that may be removably coupled to form the igniter body. One or more of the subassemblies may be opened to enable replacement of worn out or malfunctioning hot surface elements if needed.

Other features and advantages of the present disclosure will be set forth, in part, in the descriptions which follow and the accompanying drawings, wherein the preferred aspects of the present disclosure are described and shown, and in part, will become apparent to those skilled in the art upon examination of the following detailed description taken in conjunction with the accompanying drawings or may be learned by practice of the present disclosure. The advantages of the present disclosure may be realized and attained by means of the instrumentalities and combinations particularly pointed out in the appendent claims.

DRAWINGS

The foregoing aspects and many of the attendant advantages of this disclosure will become more readily appreciated as the same becomes better understood by reference to the following detailed description, when taken in conjunction with the accompanying drawings, wherein:

FIG. 1(*a*). Perspective view of a commercially available sparkless pilot igniter.

FIG. 1(*b*). Schematic diagram showing the location of the hot surface igniter assembly in the sparkless pilot igniter of FIG. 1(*a*).

FIG. 1(*c*). Schematic flow diagram showing the location of a sparkless pilot igniter of FIG. 1(*a*) in a burner management system.

Figure 2A:
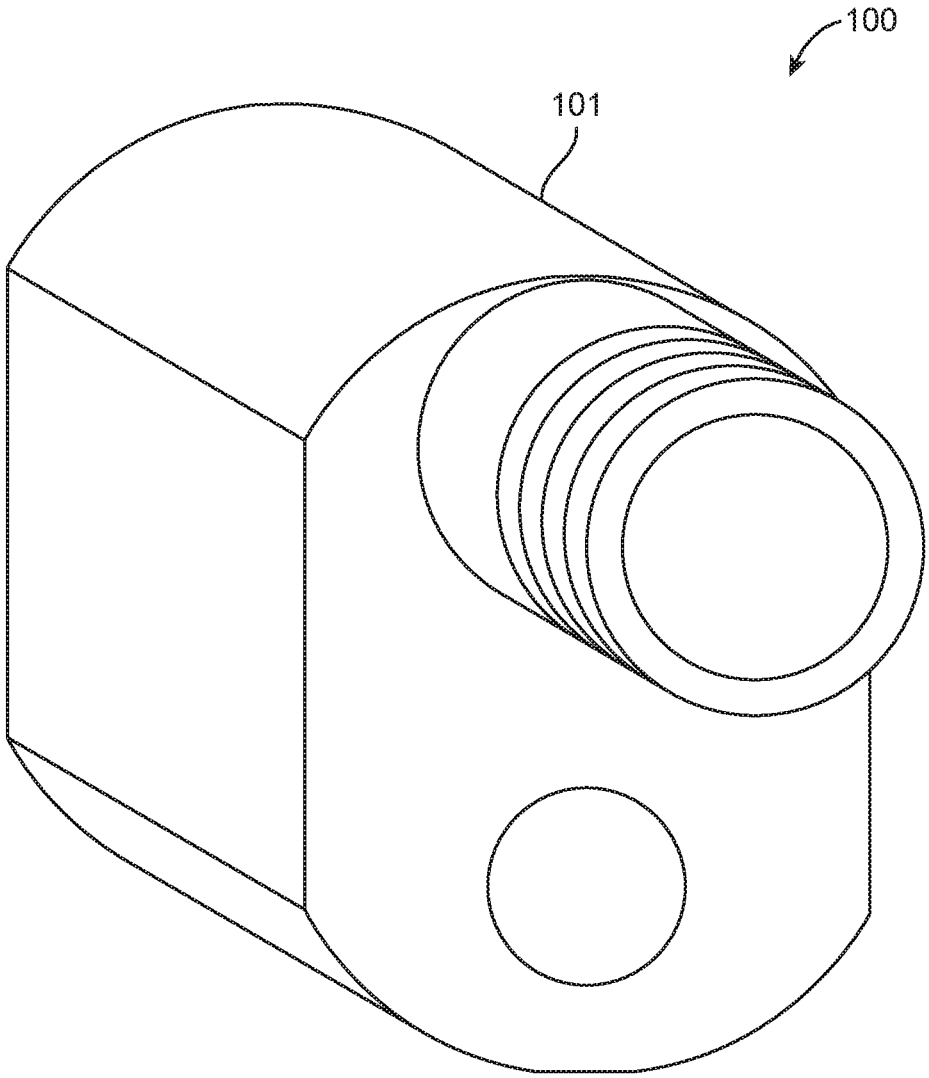
Figure 2B:
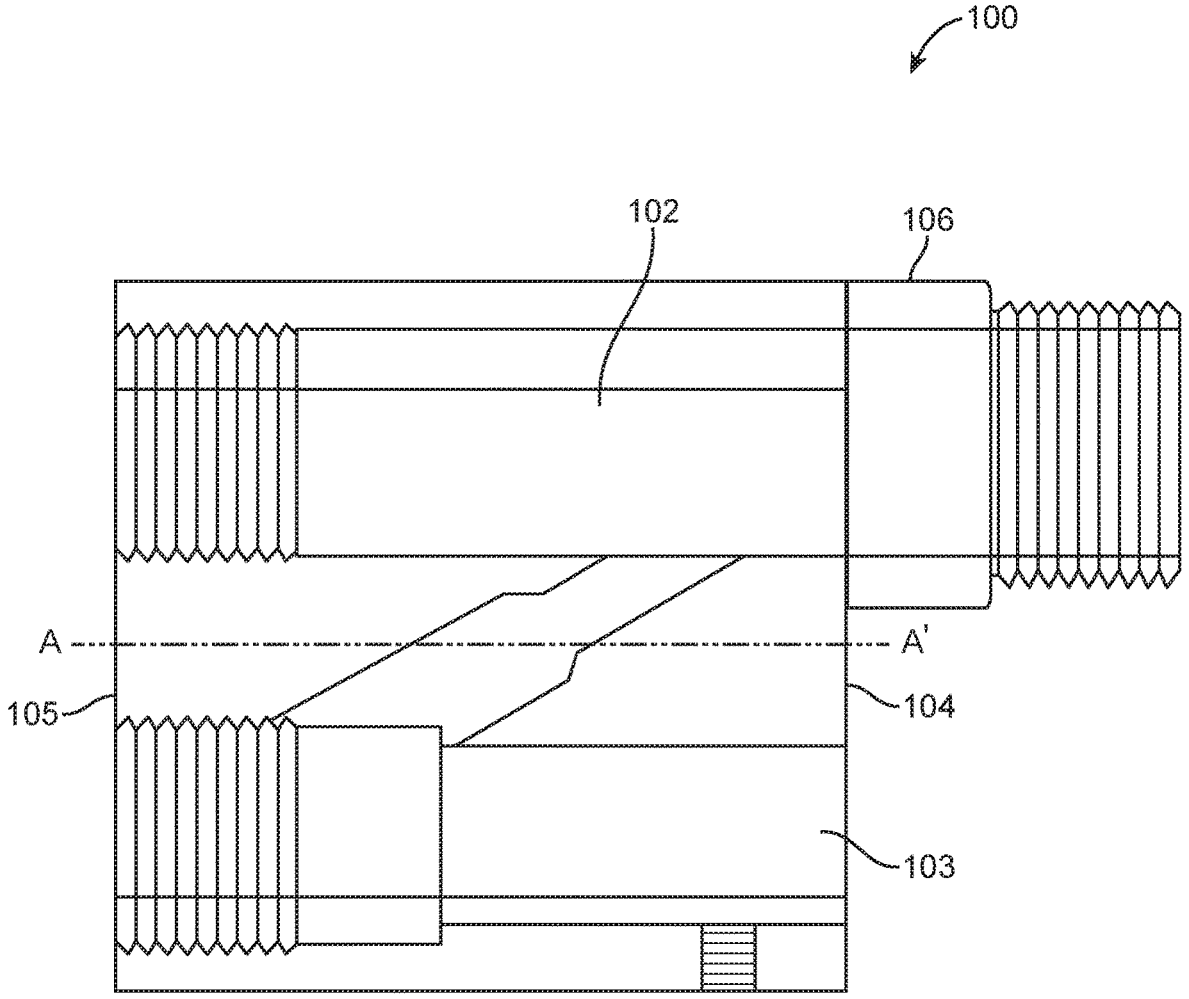
Figure 2C:
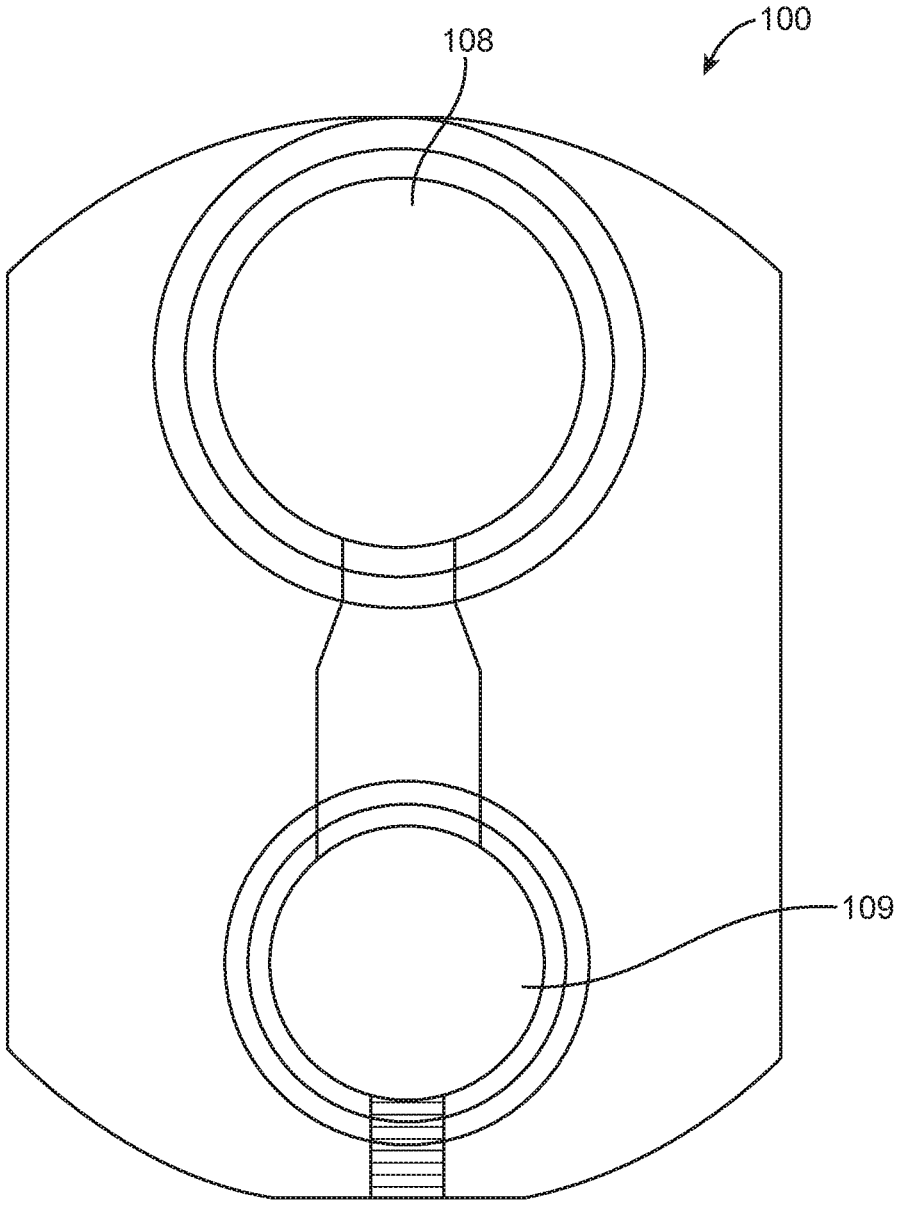

FIG. 2(*a*). Perspective drawing of an exemplary sparkless hot surface igniter body.

FIG. 2(*b*). Side view of an exemplary sparkless igniter body. Internal features are shown using lighter lines.

FIG. 2(*c*). Back end view of an exemplary sparkless igniter body.

Figure 3:
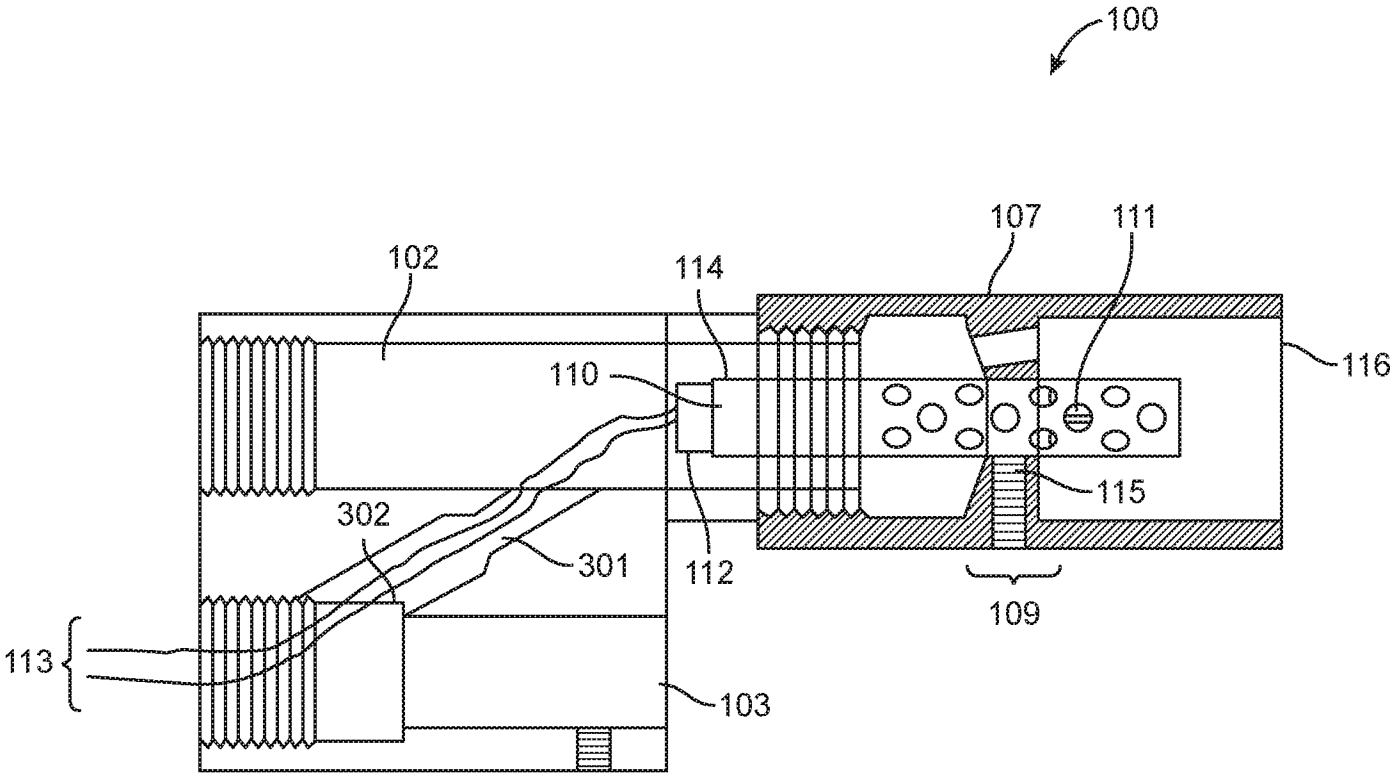

FIG. 3. Schematic diagram of the igniter nozzle showing the location of the hot surface igniter assembly in the igniter nozzle.

Figure 4:
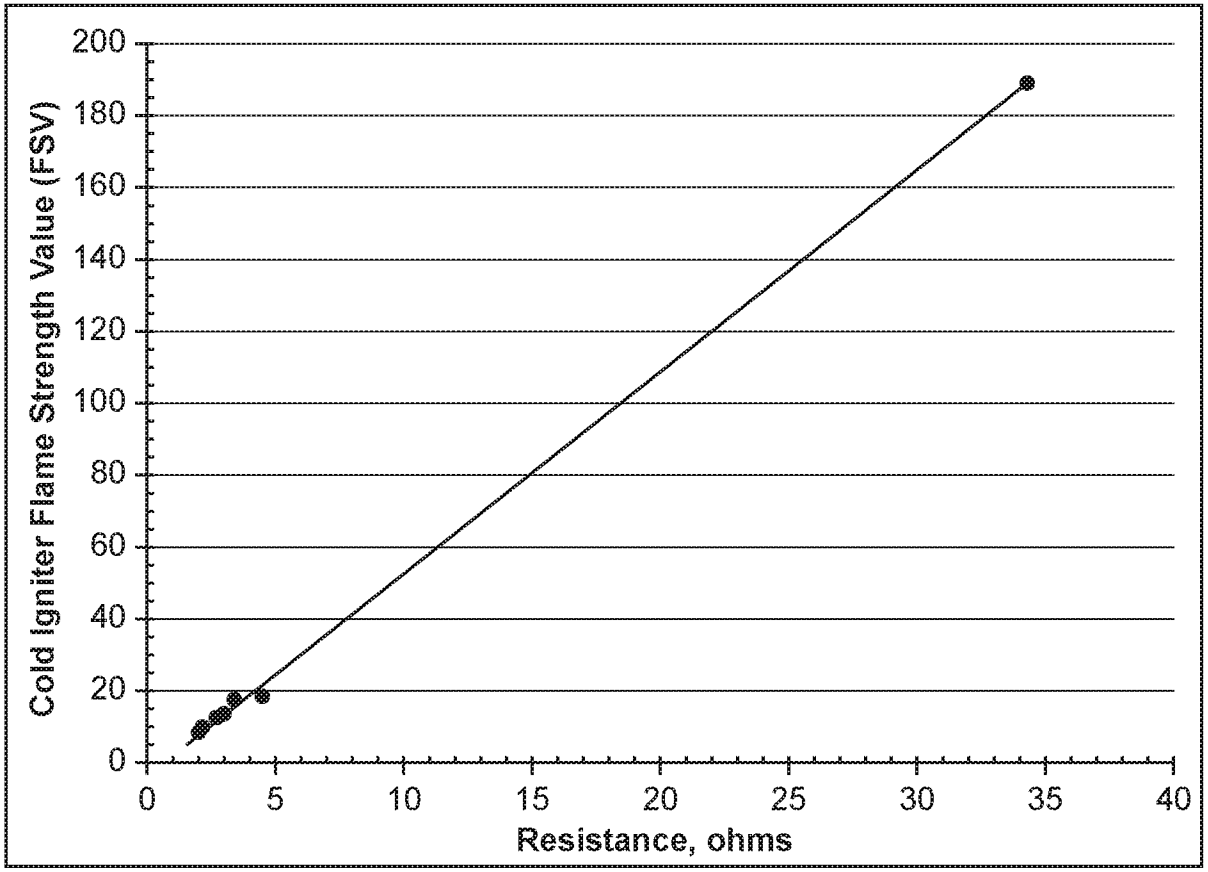

FIG. 4. Flame Strength Value (FSV) as a function of measured electrical resistance of the hot surface igniter element.

All reference numerals, designators and callouts in the figures are hereby incorporated by this reference as if fully set forth herein. The failure to number an element in a figure is not intended to waive any rights. Unnumbered references may also be identified by alpha characters in the figures and appendices.

The following detailed description includes references to the accompanying drawings, which form a part of the detailed description. The drawings show, by way of illustration, specific embodiments in which sparkless pilot igniters that can reliably operate without the use of thermocouples may be practiced. These embodiments, which are also referred to herein as "examples" or "options," are described in enough detail to enable those skilled in the art to practice the present disclosure. The embodiments may be combined, other embodiments may be utilized or structural or logical changes may be made without departing from the scope of the disclosure. The following detailed description is, therefore, not to be taken in a limiting sense and the scope of the disclosure is defined by the appended claims and their legal equivalents.

In this document, the terms "a" or "an" are used to include one or more than one, and the term "or" is used to refer to a nonexclusive "or" unless otherwise indicated. Further, "igniter," and "ignitor," should be construed to have the same meaning. In addition, it is to be understood that the phraseology or terminology employed herein, and not otherwise defined, is for the purpose of description only and not of limitation.

DETAILED DISCLOSURE

Particular aspects of the disclosure are described below in considerable detail for the purpose for illustrating its principles and operation. However, various modifications may be made, and the scope of the disclosure is not limited to the exemplary aspects described.

FIG. 2(*a*) to FIG. 2(*c*) illustrate various features of an exemplary sparkless igniter 100. The igniter has a body 101 preferably made of aluminum alloy such as the 6061 aluminum alloy. The 6061 alloy is a precipitation hardened aluminum alloy, contains magnesium and silicon as its primary alloying elements, and can withstand temperatures of at least 1000° F. Body 101 has a first internal conduit, namely, a fuel-air mixture conduit 102, and a second internal conduit, namely, an electrical conduit 103. Conduits 102 and 103 are each disposed on either side of the longitudinal axis AA' of body 101, are disposed substantially parallel to each other, and may run from the front end 104 to the back end 105 of body 101. At the front end 104, a portion of body 101 is configured to be in the form of a hollow neck 106 that is in fluid communication with the fuel-air mixture conduit 102. The free end of neck 106 is threaded to removably couple with an igniter nozzle 107 (FIG. 3). The nozzle may be made of materials such as carbon steel and stainless steel 304, is normally rated at above 2500° F., and designed to produce a well-developed steady flame of a desired flame shape. The hollow neck 106 fluidly communicates with the fuel-air mixture conduit 102 to a threaded opening 108 located at the back end 105 (FIG. 2(*c*)). Wellhead gas or fuel is pre-mixed with air prior to feeding to igniter 100 through a connection that removably connects to threaded opening 108. Pre-mixing is preferably achieved using a Wenco-1000 ¼ in.×½ in. (NPT threaded) pilot venturi mixer assembly that is equipped with a #72 1/40 in. orifice. The fuel-air mixture then flows into conduit 102.

Alternately, the igniter nozzle 107 may be suitably modified to directly couple to the igniter body 101 that does not contain the neck 106. For example, one end of the nozzle 107 may be configured to comprise a male threaded fitting that can be screwed into a mating female threaded fitting that is fluid communication with the fuel-air mixture conduit 102. Further, the nozzle may be removably attached to the conduit 102 using flanges or other quick connect fittings.

The throat 109 in nozzle 107 is located at approximately midway along the length of the nozzle (FIG. 3). The throat comprises an internal perforated region with a larger central opening and a number of smaller perforations that surround the central opening. The cylindrical hot surface ignition (HSI) assembly 110 is inserted through the central opening of the throat and is configured to fit snugly in the central opening. HSI assembly 110 is further held in place by a screwed fitting 115. HSI assembly 110 comprises an igniter heating element 111 that is substantially enclosed in a high temperature ceramic body 112. Wires 113 are electrically connected to the igniter heating element 111 and are used to energize the igniter heating element using preferably a DC (direct current) electrical source. A portion of element 111 protrudes from the ceramic body 112. A high temperature alloy guard (e.g. Inconel guard) 114 protects the ceramic body, and the exposed part of heating element 111. The diameter of the Inconel guard is preferably 0.4 inch to 0.5 inch in diameter, and more preferably 0.4 inch to 0.45 inch in diameter. HSI assembly (not including the length of the wires 113) is preferably 2 inch to 3 inch in length, and more preferably between 2 inch and 2.5 inch in length. The length of the heating element 111 that protrudes from the ceramic body 206 is preferably between 0.3 inch and 0.6 inch, and more preferably between 0.4 inch and 0.55 inch.

Nozzle 107 is preferably made of Stainless Steel 304, and is preferably between 2 inch and 4 inch in length, and more preferably between 2 inch and 3 inch in length. The outer diameter of nozzle 107 at the opening 116 is preferably between 1 inch and 2 inch, and more preferably, between 1 inch and 1.5 inch. The disclosed sparkless igniter can be scaled up or scaled down in size depending on the heat duty that is desired for the particular application.

The igniter element may comprise of durable, high temperature materials such as silicon carbide or silicon nitride. When a suitable voltage (preferably DC voltage) is applied to the element 111, it heats up to enable auto ignition of the fuel or wellhead gas in a pilot. The HSI element is heated for a predetermined time before it is exposed to the fuel-air mixture. The predetermined time for energizing the HSI may be in the order of a few seconds, and preferably between 5 seconds and 15 seconds. Auto-ignition of the fuel-air mixture on the hot surface of the HSI element of the pilot igniter then lights the main burner gas. If ignition is not detected within the predetermined time, the gas valve closes and the burner management system will repeat the start-up sequence.

In contrast to the igniter nozzle 401 of prior art igniter 400 (FIG. 1(*b*)), the HSI assembly 110 is positioned such that the portion of the heating element 111 that is not enclosed in the ceramic body 112 (exposed region of the heating element) extends out or protrudes from the throat 109 of nozzle 107; that is, the exposed region of the heating element is disposed downstream of the throat 109. In contrast, in the prior art igniter 400, the exposed region of the heating element 406 is disposed upstream of throat 404 of nozzle 401. The positioning of the HSI element as shown in FIG. 3 ensures that the exposed region of heating element 111 (also referred to as the tip of the heating element) sits adjacent to the hottest region of the flame body (or plume) and is not subject to convectional cooling by the fuel-air mixture. The temperature of the tip remains relatively uniform. As a result, the resistance of the HSI element, which is a function of temperature, is also relatively uniform. When igniter 100 is used in a burner management system and energized using a direct current (DC) source, the burner management system measures the resistance of the heating element of the HSI, and/or calculates a control parameter such as the flame strength value (FSV) that is a function of resistance. This control parameter is used to control the operation of igniter 100 without the use of flame sensors such as thermocouples or flame rods. A burner management system as disclosed in U.S. application Ser. No. 11/047,794 entitled "METHOD, APPARATUS AND SYSTEM FOR CONTROLLING A GAS-FIRED HEATER," may be modified to control the igniter using the control parameter instead of temperature. FIG. 4 shows the FSV as a function of resistance for an exemplary HSI element. As can be seen, the FSV is a function of electrical resistance, and exhibits a linear relationship with measured electrical resistance.

The FSV of a HSI element 111 is typically 12±5 units in the absence of a flame. This value may be referred to as the baseline FSV. When the HSI element is energized, preferably using a DC voltage of 12 to 24 volts, the HSI element temperature rapidly increases to auto-ignition temperature of the fuel in less than 10 seconds, and typically in less than 8 seconds. The burner management system initiates flow of fuel to the igniter. After a time period of 2 to 15 seconds, and preferably of 2 to 3 seconds, the HSI element is de-energized (voltage is cut off). Then, after a period of about 20 seconds, the FSV is measured by the burner management system to obtain the operating FSV. An operating FSV that exceeds the baseline FSV by about 3 units indicates the presence of a flame. Preferably, an operating FSV that exceeds the baseline FSV by about 8 units is desired. In the absence of a flame, the burner management system shuts-off the flow of fuel to the igniter and to the main burner. The sequence described above is repeated (cycled) until a steady flame is realized. During normal operation, the operating FSV is measured at periodic intervals to ensure the presence of a flame. A sparkles igniter in a piloted burner system may cycle between ON and OFF about 20 to 50 times a day.

HSI assemblies are available from sources that include, but are not limited to, Robertshaw, Crystal Technica, Honeywell, and the like. These igniters may be energized using 12 to 24 VDC or 120 to 280 VAC. The heating elements may be enclosed in proprietary ceramic composite materials.

The ignition wiring 113 connected to the HSI element is rated to withstand at least 1000° F. The ignition wiring 113 is disposed upstream of the throat 109 and extends into conduit 102. The wiring is then fed through an opening 301 in conduit 102 (FIG. 3), and through a corresponding opening 302 in conduit 103, and extends out the back end of igniter 100 through threaded opening 109. The wiring is preferably electrically connected to a ⅜" electrical flexible fitting, which is removably screwed (½ inch NPT) into the threaded portion 109 of electrical conduit 103. The wiring is then routed to the burner management system. Openings 102 and 103 are sealed using suitable sealant materials.

Alternately, if the burner management system that controls the operation of the exemplary pilot igniter requires a temperature input instead of FSV as the control parameter, the measured resistance may be used to predict temperature by comparing with a look-up table containing resistance values as a function of temperature, or using suitable expressions that correlate resistance and temperature. A temperature of 800° C. to 1100° C. would indicate the presence of a normal flame, and the burner management system would continue to fuel to the igniter 100.

The resistance of a conducting material is dependent on several factors or variables. For example, resistance is inversely proportional to the cross-sectional area of the material or heating element, and is directly proportional to the length of a conductive material. The resistance of a conductive material can be expressed as:

$$R = \frac{\rho L}{A} \tag{1}$$

where R is the resistance in ohms (Ω), ρ is the electrical resistivity (Ω·m), L is the length of the conductive material (m), and A is the area of cross section of the conductive material ($m^2$). Further, if the temperature of the conductive material is fairly constant, the resistance R at a temperature T above a reference temperature can be estimated as:

$$R(T)=Ro(1+\alpha(T-To) \tag{2}$$

where α is the temperature coefficient of resistance of the material at the reference temperature, $T_o$ is the reference temperature, and $R_o$ is the resistance at $T_o$. Therefore, the resistance of the HSI element at different temperatures may be estimated using the above expressions. The resistance of the HSI element in the exemplary igniter is typically about 2 ohms, and more typically between 1.9 to 2.4 ohms at 50° C.

The control parameters are not restricted to FSV and calculated temperature as described above. Other parameters may also be used by the burner management system. The measured resistance may be corrected to account for certain predetermined characteristic of the HSI element. These predetermined characteristics may include at least one of the material of the HSI element, the thickness of the element, the length of the element, and the age of the element. The method of controlling fuel flow to the igniter may be similar to that previously described when the FSV is used as the control parameter. A baseline value for the control parameter is first established. When the HSI element is energized, preferably using a DC voltage of 12 to 24 volts, the HSI element temperature rapidly increases to auto-ignition temperature of the fuel in less than 10 seconds, and typically in less than 8 seconds. The burner management system initiates flow of fuel to the igniter. After a time period of 5 to 15 seconds, and preferably of 2 to 3 seconds, the HSI element is de-energized (voltage is cut off). Then, after a period of about 20 seconds, the control parameter is measured by the burner management system to obtain the operating control parameter. An operating control parameter that exceeds the baseline parameter by about 10%, and more preferably by about 25%, indicates the presence of a flame. In the absence of a flame, the burner management system shuts-off the flow of fuel to the igniter and to the main burner. The sequence described above is repeated (cycled) until a steady flame is realized.

Further, the measured resistance of the HSI element can also be used to predict if the HSI element or assembly is wearing out. Ageing of the resistance wires may occur at high temperatures due to cyclic operation, and possibly due to some carbon formation. The resistance of the HSI element is also a function of the age of the HSI element. Ageing generally causes an increase in the resistance of the HSI element. The resistance of a fresh HSI element is about 2 ohms at a reference temperature of 50° C. (FSV=11). An aged igniter element is characterized by a resistance of about 3.5 ohms at a reference temperature of 50° C. (FSV=17). An increase in measured resistance or FSV at a reference temperature would suggest that the heating element is ageing. As a remedial measure, the energizing voltage to the HSI element may be increased in steps of about 0.5 volts (when DC voltage is used) to compensate for the aging of the heating element. Increasing the energizing voltage is warranted if the measured FSV at a reference temperature exceeds the baseline FSV by more than 50%, and preferably by more than 75% to compensate for ageing of the hot igniter surface assembly. If this action fails, replacement of the HSI element would be required. The control methods in the burner management system may also keep track of the service time of the HSI element, and increase resistance accordingly to offset the effects of ageing to achieve a predetermined ignition temperature.

In another aspect, the igniter body may comprise of more than one subassemblies that are removably coupled to form the igniter body assembly. One or more of the subassemblies may be opened to replace or swap out worn out or malfunctioning hot surface elements if needed. This permits the user to use the same sparkles pilot igniter, while changing out the HSI elements, when needed, and could lead to cost savings.

The disclosed sparkless pilot igniter requires no cleaning and adjustments once installed and commissioned in a burner management system. The use of the disclosed igniter in burner management systems is particularly beneficial when operating at remote sites because traveling to these sites is difficult and often hazardous. In addition, an alternating current source is not available at these sites, and an igniter that can operate using a direct current (DC) source is required. Likewise, working in below freezing conditions is also difficult and hazardous.

If conventional burner management systems require input from a flame sensor such as flame rod or a thermocouple, the exemplary sparkless pilot igniters may be configured to accommodate an optional flame sensor (thermocouple or flame rod) electrically connected through the electrical conduit 103 to the burner management system.

The Abstract is provided to comply with 37 C.F.R. § 1.72(b), to allow the reader to determine quickly from a cursory inspection the nature and gist of the technical disclosure. It should not be used to interpret or limit the scope or meaning of the claims.

Although the present disclosure has been described in connection with the preferred form of practicing it, those of ordinary skill in the art will understand that many modifications can be made thereto without departing from the spirit of the present disclosure. Accordingly, it is not intended that the scope of the disclosure in any way be limited by the above description.

What is claimed is:

1. A sparkless pilot flame igniter for wellhead gas comprising:

a pre-mixed wellhead gas fuel-air mixture inlet; and a nozzle in fluid communication with the fuel-air mixture inlet and located downstream of the fuel-air mixture inlet, wherein the nozzle is characterized by a length and comprises:

a throat disposed approximately midway of the length of the nozzle and comprising a perforated region having a central opening surrounded by a plurality of smaller perforations; and, a cylindrical hot surface igniter assembly having a heating element substantially enclosed in a ceramic body and an exposed heating element tip protected by a high temperature metal guard wherein the assembly is configured to be removably inserted through the central opening of the throat and fit snugly in the central opening and wherein a portion of the hot surface igniter assembly having the heating element tip protrudes from the throat in a direction opposite to the fuel-air mixture inlet, wherein the heating element is characterized by an electrical resistance and wherein the operation of the igniter is controlled by measuring the resistance of the heating element and using the change in the resistance prior to and after ignition to sense the presence or absence of a flame.

2. The igniter of claim 1 wherein the hot surface igniter element is energized using DC voltage.

3. The igniter of claim 2 wherein the DC voltage ranges from 12 to 24 volts.

4. A sparkless pilot flame igniter for wellhead gas comprising:

an igniter body comprising:

a pre-mixed fuel-air mixture conduit fluidly connected to a pre-mixed fuel-air mixture inlet; and, an electrical conduit disposed substantially parallel to the fuel-air mixture conduit; and, a nozzle in fluid communication with the fuel-air mixture conduit and located downstream of the fuel-air mixture inlet, wherein the nozzle is characterized by a length and comprises:

a throat disposed approximately midway of the length of the nozzle and comprising a perforated region having a central opening surrounded by a plurality of smaller perforations; and, a cylindrical hot surface igniter assembly having a heating element substantially enclosed in a ceramic body and an exposed heating element tip protected by a high temperature metal guard wherein the assembly is configured to be removably inserted through the central opening of the throat and fit snugly in the central opening and wherein a portion of the hot surface igniter assembly having the heating element tip protrudes from the throat in a direction opposite to the fuel-air mixture inlet, wherein the heating element is characterized by an electrical resistance and wherein the operation of the igniter is controlled by measuring the resistance of the heating element and using the change in the resistance prior to and after ignition to sense the presence or absence of a flame.

5. A method of operating a sparkless pilot flame igniter in a burner management system, the method comprising:

providing the igniter of claim 1 having a predetermined baseline resistance and energizable using a direct current (DC) source;

energizing the hot surface igniter element during a first time interval;

initiating flow of fuel-air mixture to the igniter through the fuel-air mixture inlet during a second time interval;

de-energizing the hot surface igniter assembly;

measuring the resistance of the hot surface igniter element; and, determining the presence of a flame if the value of the measured resistance exceeds that of the baseline resistance by a predetermined control value.

6. The method of claim 5 wherein the first time interval is less than 10 seconds.

7. The method of claim 5 wherein the second time interval is between 2 and 15 seconds.

8. The method of claim 5, wherein the predetermined control value is 10%.

9. The method of claim 5 wherein the DC voltage ranges from 12 to 24 volts.

10. The method of claim 5 further comprising increasing the energizing voltage in steps of 0.5 volt increments if the measured resistance at a reference temperature exceeds the baseline resistance by more than 50% to compensate for ageing of the hot surface igniter assembly.

11. The method of claim 5 wherein the first time interval is less than 8 seconds.

12. The method of claim 5 wherein the second time interval is between 2 and 3 seconds.

13. The method of claim 5, wherein the predetermined control value is 25%.

14. The method of claim 5 further comprising increasing the energizing voltage in steps of 0.5 volt increments if the measured resistance at a reference temperature exceeds the baseline resistance by more than 75% to compensate for ageing of the hot surface igniter assembly.

* * * * *